United States Patent [19]

Manning et al.

[11] 3,987,949

[45] Oct. 26, 1976

[54] FORMS BURSTING APPARATUS

[75] Inventors: Donald Franklin Manning, Endicott; Frederick William Singer, Binghamton; Joseph James Student, Apalachin, all of N.Y.

[73] Assignee: International Business Machines Corporation, Armonk, N.Y.

[22] Filed: Oct. 20, 1975

[21] Appl. No.: 624,158

[52] U.S. Cl. ..... 225/106; 225/4; 225/100

[51] Int. Cl.[2] ..... B65H 35/10

[58] Field of Search ..... 225/2, 4, 5, 94, 96, 225/100, 101, 106

[56] References Cited

UNITED STATES PATENTS 3,133,684 5/1964 Wiltshire ..... 225/101

3,895,751 7/1975 Shepherd ..... 225/106 X

*Primary Examiner*—Othell M. Simpson
*Assistant Examiner*—Fred A. Silverberg
*Attorney, Agent, or Firm*—Paul M. Brannen

[57] ABSTRACT

A forms bursting apparatus having a brake bar which grips a document to be separated, transversely holding the document during the bursting operation. A bursting bar assembly forces the leading document portion against a rotating burster roll. A bursting bar, which grips the document, is swingably mounted for rotation with the bursting roll during the bursting.

4 Claims, 7 Drawing Figures

FORMS BURSTING APPARATUS

FIELD OF THE INVENTION

This invention relates to document handling apparatus, and particularly to an improved forms burster for separating prescored or weakened documents in a continuous web into separated individual portions.

DESCRIPTION OF THE PRIOR ART

A search of the prior art has developed the following U.S. Pat. Nos. 2,328,582 — Ratchford et al.; 2,344,720 — O'Connell; 2,355,690 — Zent; 2,717,642 — Pealler; 2,862,554 — Davidson et al.; 3,794,228 — Colwill et al.; and 3,863,821 — Van Bennekom. None of the prior art, taken singly or in any proper combination, teach the unique bursting apparatus of this invention.

Previously known bursters of the type as shown in U.S. Pat. Nos. 2,344,720 and 2,717,642, for example, are characterized by a large amount of rotating parts, many of which are comprised of multiple parts, resulting in an apparatus which is complicated and relatively expensive to construct and maintain.

SUMMARY OF THE INVENTION

It is a principal object of the present invention to provide an improved forms bursting apparatus.

Another object of the invention is to provide an improved forms bursting apparatus having relatively few moving parts.

A further object of the invention is to provide an improved forms bursting apparatus utilizing relatively simple parts, providing an uncomplicated and economical arrangement.

Another object of the invention is the minimum surface contact of the bursting apparatus, eliminating contact with the printed surface or the readjustment of the apparatus for various size forms.

Other objects of the invention and features of novelty and advantages thereof will become apparent from the detailed description to follow, taken in connection with the accompanying drawings.

In practicing the invention, there are provided, on one side of the web or document path, a stationary brake bar and a continuously rotating bursting roll with its surface moving in the same direction as the web travel. On the opposite side of the web path are a pair of reciprocable bar members, one aligned with the stationary brake bar and the other aligned with the bursting roll.

As the web moves, the reciprocable members are actuated to grip the web against the stationary brake bar and the rotating bursting roll. The actuation is timed to cause engagement when the weakened or tear zone is between the reciprocable members. This results in the web being momentarily stopped on one side of the tear zone, while the roll and bursting bar move the web on the other side of the tear zone to cause separation.

GENERAL DESCRIPTION OF THE DRAWINGS

In the drawings.

Similar reference characters refer to similar parts in each of the several views.

DETAILED DESCRIPTION OF THE DRAWINGS

Figure 1:
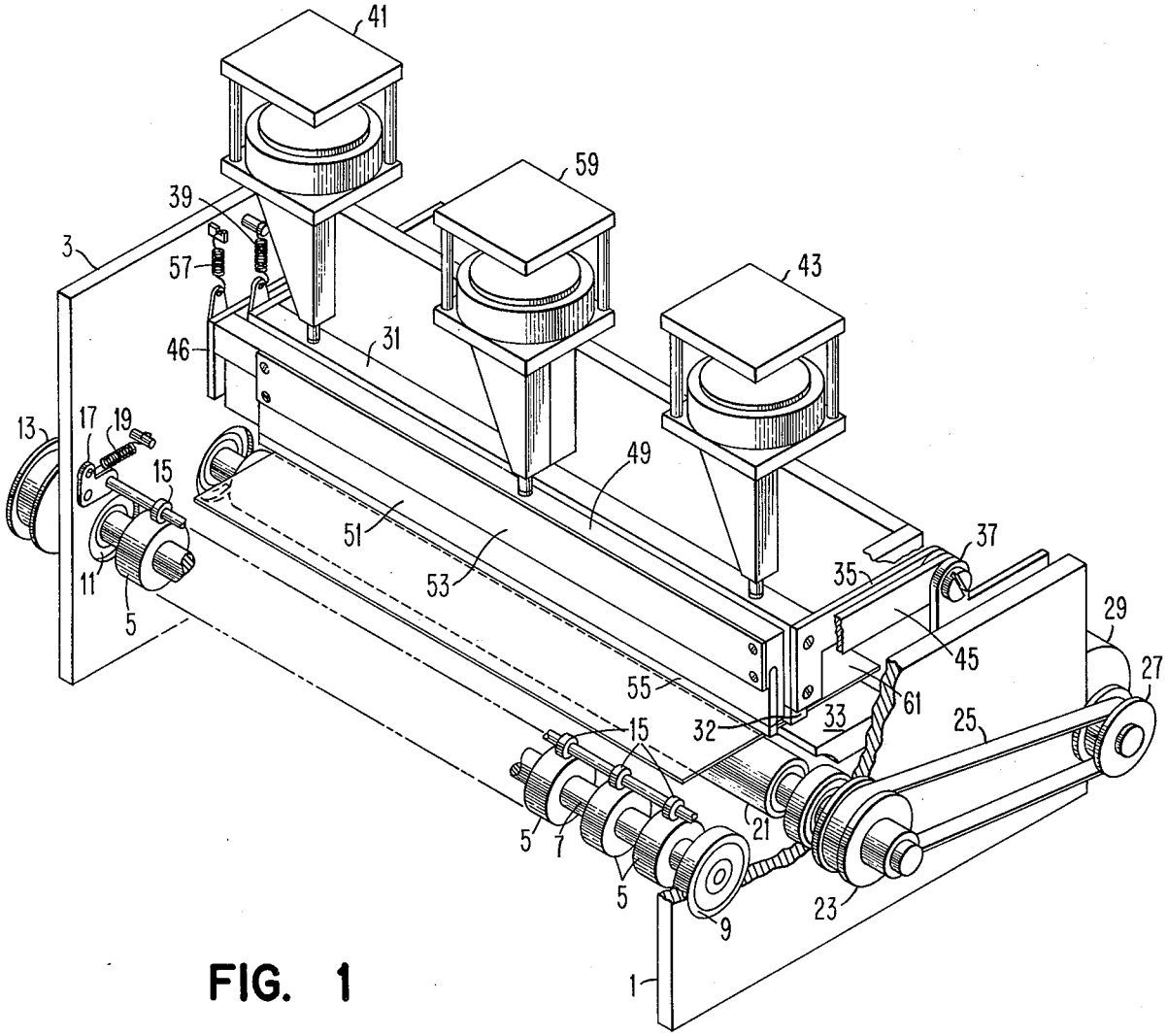
FIG. 1 is a schematic isometric illustration of an improved bursting apparatus in accordance with the present invention.

Referring to FIG. 1 of the drawings, there is shown a perspective view of a preferred embodiment of the present invention arranged for bursting forms.

All the apparatus is mounted on or in relation to a pair of side plates or frames 1 and 3.

Forms are fed to and through the burster station by document transport means here shown as including a transport roll assembly comprising a plurality of rollers 5 on a shaft 7 which rotates in bearings 9, 11 mounted in the side frames and transport roll is driven by suitable prime mover means not shown which may be coupled to the transport roll shaft 7 via the pulley 13.

Idler rolls such as 15 are movably mounted as by bell cranks such as the crank 17, biased via tension spring 19 so that the idler rolls 15 are in contact with the transport rolls 5 to thereby grip a document for movement between rolls. A bursting roll 21 is also journaled in suitable bearings in the side frames, and arranged to be driven via a pulley and belt combination 23, 25, 27, from a motor 29.

A brake bar 31 is suspended above a brake plate 33 in the manner shown in the drawing by a pair of arms such as arm 35, pivotally mounted at 37 to the side frames. The other end of brake bar 31 is similarly mounted for up and down motion. The brake bar is maintained in an inoperative or raised position by means such as tension springs, one of which is shown at 39.

Brake bar 31 is moved to its operative position into contact with the document and the brake plate 33, by energization of a pair of solenoids 41 and 43. When the solenoids are energized, the brake bar is moved to its lower position, where it engages brake plate 33 to stop the motion of the forms passing through the burster. The lower portion of brake bar 31 is provided with resilient material such as a rubber strip 32 cemented or otherwise affixed to the lower portion of the brake bar, to afford better gripping of the document by the brake bar and the associated brake plate. Also, mounted on the pivot 37 by means of arms such as 45 and 46 is a bursting bar assembly 49, comprising a bursting bar 51 and a bursting bar support spring 53. The bar and supporting spring are relatively flat elongated strips, the bursting bar 51 being provided at its lower edge with a strip of resilient material 55 and mounted in the bursting bar assembly to be supported by the flat spring 53.

As can be seen from the drawing, the bursting bar 51 is held in place by the flat spring in such manner that it is free to rotate or swing slightly when it is brought down and engaged with the document backed up by the bursting roll 21.

The bursting bar assembly is maintained in its normal or raised position by means of tension springs such as the spring 57. The bursting bar is moved to its operative position by energization of a solenoid 59, which is controlled in a manner to be subsequently described.

In FIG. 1 there is shown a document 61 being transported through the burster, riding over brake plate 33, and passing between the bursting roll 21 and the bursting bar assembly 49.

Figure 2A:
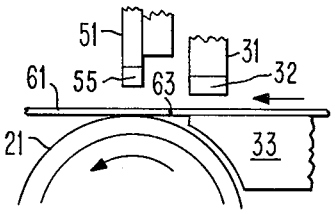
FIGS. 2A, 2B, 2C and 2D are schematic cross-section views of a portion of the apparatus of FIG. 1, illustrating the relationship of the parts at various times during an operating cycle.

Referring now to FIGS. 2A through 2D respectively, there is shown in cross-sectional diagrammatic form the action of the apparatus during the bursting operation. As shown in FIG. 2A, the document 61 is passing through the apparatus over brake plate 53 and beneath brake bar 31, and traversing the bursting roll 21, over which is suspended the bursting bar 51. Reference character 63 indicates one of the scored portions or tear zones extending across the document 61, at which point the documents are to be separated.

Figure 2C:
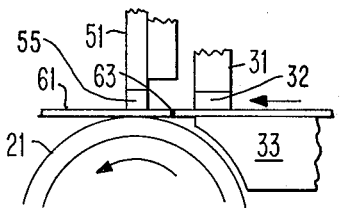
Figure 2B:
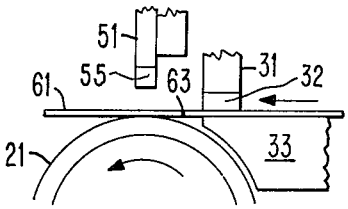

In FIG. 2B, the brake bar 31 has been applied as a result of energization of the solenoids 41 and 43, and the rightmost portion of document 61 is thereby compressed between the resilient strip mounted on the lower edge of brake bar 31 and the brake plate 33, thus arresting the forward motion of document 61.

Figure 2D:
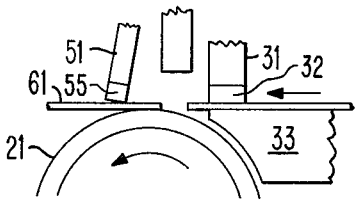

At FIG. 2C, the bursting bar 51 has been lowered into engagement with the leftmost portion of document 61 backed up by the bursting roll 21. Rotation of the burster roll 21 in the counterclockwise direction as shown will cause rotation of the bursting bar 51 as shown in FIG. 2D, and since the document is gripped between bursting bar 51 and roll 21, the bursting force will be exerted on the leftmost portion of document 61, and it will be parted from the rightmost portion which is held by the brake bar 31 and brake plate 33. The apparatus is then returned to its initial condition, with the bursting bar 51 restored to its normal vertical position by the action of the flat restoring spring 53.

Figure 3:
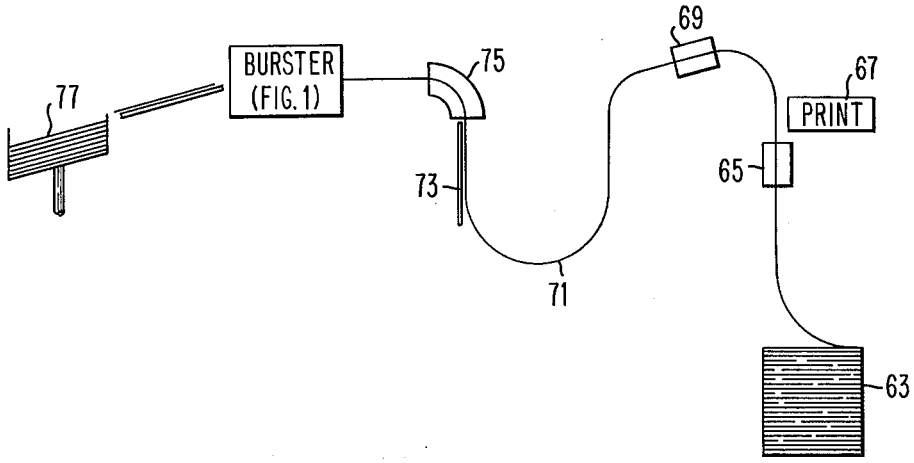
FIG. 3 is a schematic illustration showing the use of the apparatus of FIG. 1 in connection with a line printer.

In FIG. 3 of the drawings, there is shown the relationship of the burster apparatus described above to the remainder of the printer equipment. The forms to be printed are supplied from a suitable folded supply stack 63, and past a first tractor 65 and a printing station 67, the details of which are not shown since they are not germane to the present invention. Suffice it to say that the required printing on the forms takes place at print station 67, from which the forms are extracted by a tractor 69. A slack loop 71 in the printed document is formed as shown, so that the intermittent stopping of the forms as a result of operation of the burster will not be reflected in the operation of the printing station 67. The documents are then fed over suitable paper guides 73 to a burster tractor 75, and then through the burster apparatus as shown in FIG. 1, following which the separated documents are supplied to a suitable document stacker 77.

Figure 4:
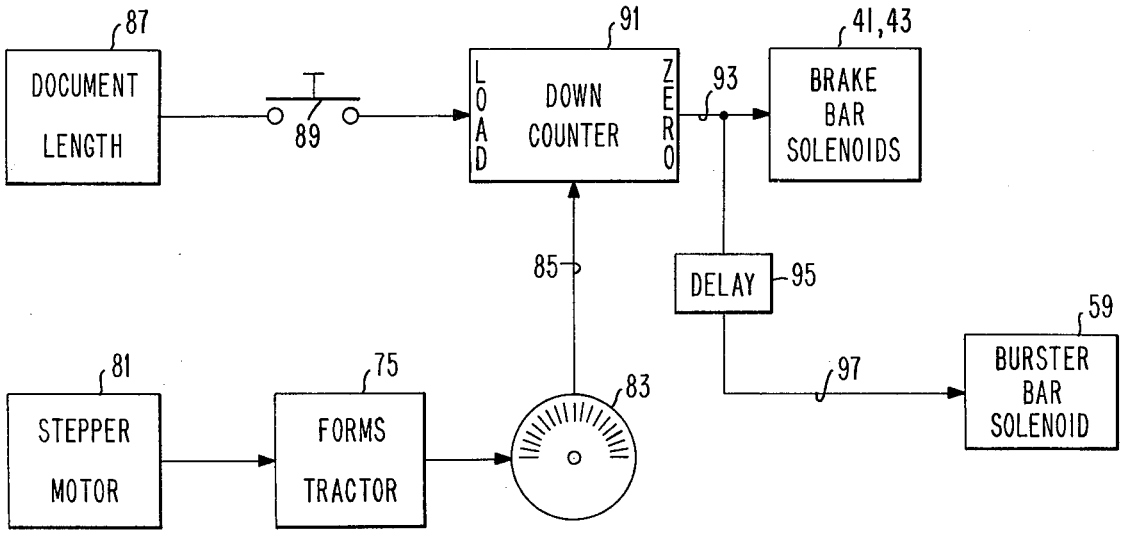
FIG. 4 is a schematic diagram of one form of control system which may be used with this invention.

In FIG. 4, there is shown in a schematic form one arrangement which may be used to control the operation of the burster apparatus shown in FIG. 1. A stepper motor 81 drives the forms tractor 75 associated with the burster. Driven by the forms tractor is an emitter 83, which may be of any conventional type, such as a slotted disk and photocell arrangement. The emitter 83 produces a series of output pulses on a line 85, the pulses occurring in exact synchronism of motion of the forms tractor 75 as driven by stepper motor 81. It will be apparent that the pulses on line 85 occur synchronously with the motion of the paper being supplied by the forms tractor through the burster apparatus.

The document length is set into a suitable storage 87, from whence it is supplied by operation of a "load" button 89 to the input of a down counter 91.

Down counter 91 is a counter of conventional well-known arrangement in which a predetermined number can be loaded, and then the counter will proceed to count down from that predetermined number until a count of zero is reached. The counting is accomplished by the supply to the down counter 91 of the pulses on line 85. When a zero count is reached, an output signal is supplied on line 93 to the brake bar solenoids 41 and 43. Thus the brake bar will be actuated to bring the document to a halt with the transverse perforations in the position shown in FIG. 2B. The signal on line 93 is also supplied to a delay circuit of conventional nature 95, from whence a signal is supplied on line 97 to the bursting bar solenoid 59. Thus, shortly after the brake bar solenoids are energized to halt the paper, the bursting bar solenoid is activated and the bursting bar seizes the preceding portion of the document to cause the document to be parted as shown in FIG. 2D. Details of the apparatus shown in FIG. 4 are not shown or described, since the devices are conventional and well known in nature and their exact form is not a part of the present invention.

From the foregoing, it will be apparent that the structure disclosed above provides a document bursting apparatus which is arranged so that the bursting hardware touches the paper in an area within a very small dimension to each side of the perforation or weakened area. With previously known bursters the feed rolls and bursting hardware are in constant touch with the paper and with any wet printing process causes smudging of the printing. Since the operator can load the document length electronically into the storage 87, he can choose to burst each document or every second or third document, or whatever interval he wishes. The burster constructed in accordance with the present invention is compact and may be fitted within the printer with which it is designed to operate rather than having it as a separate stand-alone apparatus.

While the invention has been particularly shown and described with reference to a preferred embodiment thereof, it will be understood by those skilled in the art that various changes in form and details may be made therein without departing from the spirit and scope of the invention.

We claim:

1. Forms bursting apparatus comprising, in combination, means for moving along a path a web having transverse preweakened tear zones therein to permit separation of said web into sheets, a stationary brake plate across which the web is passed, a brake bar reciprocable between an inoperative and an operative position, said brake bar gripping the web against said brake plate when in its operative position, a burster roll over which said web passes, said roll rotating in the direction of travel of the web, a burster bar operative between a first position and a second position, said bar comprising said web against said burster roll when in said second position, and means for sequentially operating said brake bar and said burster bar.

2. The combination as claimed in claim 1, in which said burster bar is rotatable through a fixed arc by contact with said document and said roll.

3. The combination as claimed in claim 2, in which said burster bar is supported by a flat spring.

4. The combination as claimed in claim 2, in which the web-engaging edges of the brake bar and the burster bar are provided with resilient material.

* * * * *

UNITED STATES PATENT OFFICE

CERTIFICATE OF CORRECTION

PATENT NO. : 3,987,949

DATED : October 26, 1976

INVENTOR(S) : Donald Franklin Manning et al

It is certified that error appears in the above-identified patent and that said Letters Patent are hereby corrected as shown below:

Column 3, line 1, insert a comma --,-- after "FIG. 1";
line 9, the reference numeral "53" should read --33--.
Column 4, line 56, "comprising" should read --compressing--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*